US006627272B2

(12) United States Patent
Nakamura

(10) Patent No.: US 6,627,272 B2
(45) Date of Patent: Sep. 30, 2003

(54) INK JET RECORDING SHEET

(75) Inventor: Atsushi Nakamura, Shizuoka (JP)

(73) Assignee: Nisshinbo Industries, Inc., Tokyo (JP)

( * ) Notice: Subject to any disclaimer, the term of this patent is extended or adjusted under 35 U.S.C. 154(b) by 0 days.

(21) Appl. No.: 09/881,839

(22) Filed: Jun. 18, 2001

(65) Prior Publication Data

US 2002/0012778 A1 Jan. 31, 2002

(30) Foreign Application Priority Data

Jun. 20, 2000 (JP) ..... 2000-184798

(51) Int. Cl.[7] ..... B41M 5/00

(52) U.S. Cl. ..... 428/32.13; 428/32.19; 428/32.22

(58) Field of Search ..... 428/195, 32.13, 428/32.19, 32.22

(56) References Cited

U.S. PATENT DOCUMENTS 5,276,003 A * 1/1994 Koshizuka ..... 428/195

* cited by examiner

*Primary Examiner*—Pamela R. Schwartz
(74) *Attorney, Agent, or Firm*—Armstrong, Westerman & Hattori, LLP.

(57) ABSTRACT

The present invention relates to a back print type ink jet recording sheet, and, particularly, an object of the invention is to provide an ink jet recording sheet coping with oily ink. The ink jet recording sheet comprising an intermediate layer and an ink-receiving layer laminated on a light-transmittable substrate, wherein the intermediate layer is formed of a rubber-based resin, the receiving layer is formed of a hydrophobic resin and a ratio Y/X of reflection density Y of the substrate side to reflection density X of the receiving layer side in a print section when printing using oily ink on the receiving layer is 1.0 or more.

1 Claim, 1 Drawing Sheet

INK JET RECORDING SHEET

BACKGROUND OF THE INVENTION

1. Field of the Invention

The present invention relates to a back print type ink jet recording sheet, and, particularly, to an ink jet recording sheet coping with oily ink.

2. Description of the Related Art

An ink jet recording system is a system in which ink droplets are jetted towards a surface of a recording sheet at a high velocity from an ink exit port (nozzle) of a printer to form a recording image on the surface of the sheet. This system enables high speed character and image printing, makes it easy to attain multi-coloration, is suitable for the recording of a large-scaled image, makes a smaller sound during recording and is reduced in running cost. This is why printers using this system in personal computers used in offices and for household use are being spread rapidly.

Also, because the ink jet recording system is suitable for the recording of a large-scaled image as aforementioned, it is preferably used for the printing on large-scaled sign-boards, posters, illumination sheets and the like used outdoors. However, in conventional ink jet recording systems, aqueous ink is primarily used. As to recording sheets, those for the aqueous ink have been developed. These sheets therefore have the problem of inferior weatherability and water resistance when printing is made on large-scaled sign-boards, posters, illumination sheets and the like using these sheets.

In light of these problems, a back print type recording sheet has been developed which uses a transparent or semitransparent plastic film as its base material and is used in the following system: a reverse image is printed from the side of an ink-receiving layer disposed on the film by using an ink jet system and the printed image is viewed from the side opposite to the printed surface, namely from the substrate side. Recording sheets of this type are advantageous in view of weatherability, water resistance, and the like since the substrate side is made to face outside and are therefore widely spread.

Conventionally, in this back print type, those having a structure in which an intermediate layer is disposed on a substrate and an ink-receiving layer is disposed on the intermediate layer are known. It is designed such that the receiving layer allows ink to permeate and the intermediate layer absorbs the ink. Because ink is absorbed in the side close to the substrate, the back print type has the characteristics that it has high water resistance and the density of the print viewed from the backface is high. For example, back print type ink jet recording sheets in which an ink-absorbing layer and an ink-passing layer are laminated on a light-transmittable substrate are described in Japanese Patent Application Laid-Open No. 10-329410 and Japanese Patent Application Laid-Open No. 10-44586. Because in the recording sheets disclosed in these publications, the plane to be viewed is the surface of a transparent film of the substrate, such an effect that a reduction in glossiness is small and an image similar to a silver salt photograph can be expressed due to subtle light scattering in the transparent film is obtained.

Meanwhile, the use of oily ink has been increased in the ink jet recording system in recent years. This reason is that the oily ink is superior in water resistance, so that the print product can be preferably used outdoors and the problem of the clogging of a nozzle is improved with the development of oily ink bettered in the dispersion of a pigment, the improvement of a printer, and the like.

In view of this, it is considered that a print product superior to that obtained in the case of using aqueous ink in the weatherability, water resistance, and the like is obtained if a back print is made using oily ink.

However, recording sheets used in the conventional back print system is made on the assumption that aqueous ink is used. Therefore, if a print is made on the recording sheet by using oily ink, ink is not absorbed in an intermediate layer, specifically, an ink solvent which is volatilized with difficulty remains at the interface between the ink-receiving layer and the intermediate layer. Hence, the ink-absorbing ability of the recording sheet as a whole is not improved and the ink-receiving layer cannot embrace ink, giving rise to the problem of the occurrence of such a phenomenon (bleeding) that the ink diffuses excessively in a lateral direction (a direction perpendicular to the direction in which ink is jetted).

SUMMARY OF THE INVENTION

Accordingly, it is an object of the present invention to provide a new ink jet recording sheet which enables a desirable back print without the occurrence of bleeding even when oily ink is used and which is used in place of an ink jet recording sheet for aqueous ink which is primarily used in a conventional back print system.

The structure of the present invention made to attain the object of solving the above problem is as follows. Specifically, the present invention relates to an ink jet recording sheet comprising an intermediate layer and an ink-receiving layer laminated on a light-transmittable substrate, wherein the intermediate layer is formed of a rubber-based resin, the receiving layer is formed of a hydrophobic resin and a ratio Y/X of reflection density Y of the substrate side to reflection density X of the receiving layer side in a print section when printing is made using oily ink on the receiving layer is 1.0 or more.

Specifically, the inventors of the present invention have made earnest studies based on the fact that when a back print is made using oily ink on a recording sheet for aqueous ink, the absorbing capacity is deficient, leading to the occurrence of bleeding and found that if a rubber-based resin is used for an intermediate layer and this layer is made to absorb a solvent of the oily ink, the ink is absorbed much in the substrate side, so that the print density as viewed from the substrate side is higher without any bleeding. Thus, the present invention has been completed.

In addition to the above structure in the present invention, the rubber-based resin forming the intermediate layer may be a styrene-butadiene resin or a polynorbornene resin.

DESCRIPTION OF THE PREFERRED EMBODIMENTS

Figure 1:
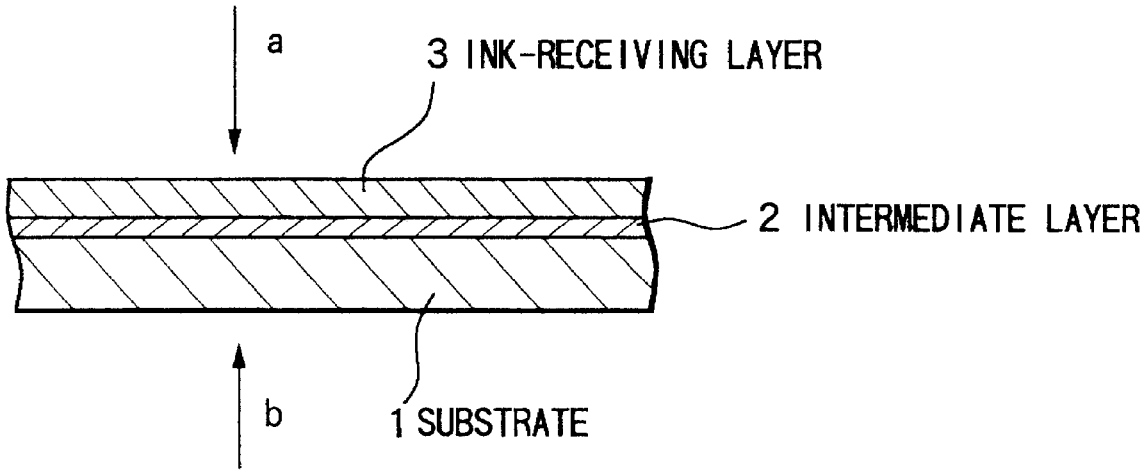
FIG. 1 is a sectional view of an example of an ink jet recording sheet according to the present invention.

An embodiment of the present invention will be hereinafter explained in detail. FIG. 1 is a sectional view of an example of an ink jet recording sheet according to the present invention.

In FIG. 1, 1 represents a substrate, 2 represents an intermediate layer and 3 represents an ink-receiving layer. Ink is jetted to the side of the ink-receiving layer 3 of the ink jet recording sheet of the present invention as shown by the arrow a to form a print portion (image as a reverse image) and the print portion is viewed from the side of the substrate 1 as shown by the arrow b.

As the above substrate 1, a transparent plastic film is used. Examples of the transparent film include transparent thermoplastic films, polyvinyl alcohol films and stretched films obtained by stretching these films. Examples of the thermoplastic films include films of polyethylene terephthalate, polypropylene, polystyrene, polyvinyl chloride, polymethylmethacrylate, polyethylene and polycarbonate. Films obtained by providing the above films with an antistatic layer and by processing the above films by electric discharge process (to improve the adhesion of the intermediate layer) may be preferably used.

Next, the intermediate layer 2 is primarily constituted of a binder resin. The intermediate layer 2 may be mixed with a filler such as silica or titanium oxide with the intention of preventing blocking. It is required for the above binder resin to absorb and hold a high-boiling point petroleum solvent which is a solvent for oily ink. The binder resin must be types which are dissolved in a high-boiling point petroleum solvent and/or swelled by the high-boiling point petroleum solvent. Examples of such a resin include styrene type resins and rubber-based resins. These resins may be used either singly or by mixing them. An acrylic resin, polyester resin or urethane resin may be contained in addition to the above compounds.

Examples of the above styrene type resin include styrenated alkyd resins, styrene/acrylate copolymer resins and substitution derivatives of these resins. The substitution derivatives include those carboxylated or further made reactive to an alkali.

Examples of the rubber-based resin include styrene/butadiene copolymer resins, acrylonitrile/butadiene copolymer resins, methacrylate/butadiene copolymer resins, acrylonitrile/styrene/butadiene copolymer resins, methacrylate/styrene/butadiene copolymer resins, urethane acrylate rubber, polynorbornene resins or substitution derivatives of these resins. The substitution derivatives include those carboxylated or further made reactive to an alkali.

Among these resins forming the above intermediate layer 2, particularly styrene/butadiene copolymer resins and polynorbornene resins are highly soluble or swelled in a high-boiling point petroleum solvent. As the high-boiling point petroleum solvent as a solvent for the oily ink, isoparaffin or paraffin is preferably used.

The thickness of the intermediate layer 2 is about 1 to 15 $\mu$m and more preferably about 2 to 10 $\mu$m. However, this thickness is optionally controllable corresponding to the conditions such as types of solvent. It is to be noted that the intermediate layer 2 may have a structure comprising two or more layers.

The intermediate layer 2 has the ability to absorb an ink solvent. Specifically, the solvent of the ink received into the ink-receiving layer 3 reaches the intermediate layer 2 through the ink-receiving layer 3 and is absorbed in the intermediate layer 2. Therefore, the ink-absorbing ability of the recording sheet as a whole is improved whereby the intermediate layer 2 serves to prevent the ink from bleeding in the ink-receiving layer 3.

Here, to explain the oily ink, the oily ink includes a type using a pigment as the colorant and a type using a dyestuff as the colorant. As the solvent, those which have high boiling points and are vaporized with difficulty are used. In the case of the oily ink using a pigment as the colorant, the pigment is prevented from penetrating into pores of the intermediate layer 2 and is not absorbed in the intermediate layer 2. However, because the solvent is absorbed in the intermediate layer 2, the pigment is drawn near to the interface between the ink-receiving layer and the intermediate layer in the ink-receiving layer and fixed to the interface firmly and stably. The bleeding is not caused accordingly. On the other hand, in the case of the oily ink using a dyestuff as the colorant, the dyestuff is absorbed in the intermediate layer 2 together with a solvent and therefore bleeding does not occur. In short, the colorant such as a pigment or a dyestuff in ink which colorant is received by the ink-receiving layer 3 is drawn near to the side of the intermediate layer 2 in the process in which the solvent is absorbed in the intermediate layer 2. Although there is such a difference that the pigment remains at the interface between the ink-receiving layer 3 and the intermediate layer 2 in the ink-receiving layer 3 and the dyestuff enters the inside of the intermediate layer 2, the bleeding caused since the solvent is not absorbed in the intermediate layer 2 does not occur. So the print density as viewed from the backface (substrate side) can be made high.

Next, the ink-receiving layer 3 in the present invention primarily comprises a binder resin and a filler to form a porous surface layer. As the binder resin, hydrophobic resins are preferable and examples of these hydrophobic resins include resins such as polystyrene, polyvinyl chloride, polyvinylidene chloride, polyacrylonitrile, polyester, vinyl chloride/vinyl acetate copolymers, alkyds, SBR, ABS, ethylene/vinyl acetate copolymers, urethane and acrylic types. Also, there is no limitation on the filler as to whether it is inorganic or organic and as the filler, polystyrene, polymethylmethacrylate, styrene/acryl copolymers, urea-formalin resins, synthetic silica, diatomaceous earth, calcium carbonate and burned kaolin are preferably used.

The thickness of the ink-receiving layer 3 is about 10 to 60 $\mu$m and preferably about 20 to 50 $\mu$m.

This receiving layer 3 is possessed of the qualities which allows oily ink to permeate and constituted of a hydrophobic binder. Therefore, the ink-receiving layer itself and the printed image are both superior in water resistance and no trace of water droplets called a watermark remains when water is poured.

As a system of applying the intermediate layer 2 and the receiving layer 3 in the ink jet recording sheet of the present invention, various methods such as known reverse roll coating, air knife coating, gravure coating and blade coating may be used.

The ink jet recording sheet of the present invention is as aforementioned. In addition, when the reflection density measured from the surface side of the ink-receiving layer is designated as X and the reflection density measured from the substrate side is designated as Y, the ratio of Y/X is preferably 1.0 or more and more preferably 1.1 or more to better an image viewed from the backface (substrate side).

The present invention is as aforementioned. The ink jet recording sheet of the present invention which is obtained in the above manner produces such a significant effect that the print density as viewed from the substrate side is made high when printing using oily ink and no bleeding occurs even if a print is made using oily ink.

Also, because the ink jet recording sheet of the present invention has high water resistance and is superior in the ability of fixing oily ink, a back print type poster or large-sized sign-board can be made using the ink jet recording sheet together with oily ink having high water resistance. Even if these products are used outdoors, the printed image is never blurred by moisture or the like. Here, to explain the water resistance, although the back print type is basically superior to the front print type in the water resistance of the print portion, the present invention makes it possible to use oily ink thereby more improving the water resistance. In addition, because the present invention uses a hydrophobic resin for the ink-receiving layer, the water resistance of the non-print portion of the receiving layer is also improved.

EXAMPLES

Next, examples and comparative examples of the ink jet recording sheet of the present invention will be explained.

Example 1

Using a transparent polyester film 100 μm in thickness as a substrate, a coating liquid prepared by 100 parts by weight of a styrene/butadiene copolymer resin (Tufprene 912, manufactured by Asahi Chemical Industry) was dissolved in 400 parts by weight of toluene was applied as an intermediate layer to one surface of the transparent polyester film by using a reverse roll coater such that the thickness of the dry film was 5 μm.

Next, as an ink-receiving layer, 56 parts by weight of a vinyl chloride/vinyl acetate copolymer emulsion (Vinyblan 386, manufactured by Nissin Chemical Industry, solid concentration: 45%), 6 parts by weight of a urea-formalin resin (manufactured by Nippon Kasei Chemical, Submicron Filler) as a pigment and 17 parts by weight of diatomaceous earth (manufactured by SHOWA CHEMICAL INDUSTRY CO., LTD, Radiolite F) (namely, the ratio F/R of the weight F of the solid content of the pigment to the weight R of the solid content of the binder resin was 1.35) were stirred sufficiently and dispersed by a sand grinder to form a coating liquid. The coating liquid was applied to the intermediate layer formed on the substrate by using a reverse roll coater such that the dry film thickness was 30 μm to obtain an ink jet recording sheet as a first example of the present invention.

Example 2

An ink jet recording sheet as a second example of the present invention was obtained in the same manner as in Example 1 except that a coating liquid obtained by adding 400 parts by weight of toluene to 100 parts by weight of a polynorbornene resin (Norsorex NSX-L, manufactured by Zeon Kasei, solid concentration: 1%) and by stirring the mixture sufficiently was applied using a reverse roll coater such that the dry film thickness was 5 μm to form an intermediate layer.

Comparative Example 1

An ink jet recording sheet as a comparative example 1 was obtained in the same manner as in Example 1 except that an aqueous polyvinyl alcohol (Gohsenol GH-17, manufactured by The Nippon Synthetic Chemical Industry, solid concentration: 5%) was applied using a reverse roll coater such that the dry film thickness was 5 μm to form an intermediate layer.

Comparative Example 2

An ink jet recording sheet as a comparative example 2 was obtained in the same manner as in Example 1 except that, as the intermediate layer, a styrene/alkylacrylate copolymer resin (Acronal YJ-6221D, manufactured by BASF Dispersions, solid concentration: 49%) was applied using a reverse roll coater such that the dry film thickness was 5 μm.

Example 3

As an ink-receiving layer, 28 parts by weight of a vinyl chloride/vinyl acetate copolymer emulsion (Vinyblan 386, manufactured by Nissin Chemical Industry, solid concentration: 45%) and 13 parts by weight of a urea-formalin resin (manufactured by Nippon Kasei Chemical, Submicron Filler) as a pigment (namely, the ratio F/R of the weight F of the solid content of the pigment to the weight R of the solid content of the binder resin was 1.0) were stirred sufficiently and dispersed by a sand grinder to form a coating liquid. The coating liquid was applied to the intermediate layer formed on the same substrate and intermediate layer as those of Example 1 by using a reverse roll coater such that the dry film thickness was 30 μm to obtain an ink jet recording sheet as a third example of the present invention.

The ink jet recording sheets obtained in the above Examples 1, 2 and 3 and Comparative Examples 1 and 2 were evaluated as follows.

(Method of Evaluation)

(1) Bleeding of Ink

Oily inks (cyan) and (magenta) were overprinted on each other using a commercially available ink jet printer. After 24 hours passed, the bleeding of ink from the periphery of the overprinted part was evaluated visually.

(2) Reflection Density

Four colors of oily inks (black), (cyan), (magenta) and (yellow) were printed using a commercially available ink jet printer. After 24 hours passed, the value (X) of the reflection density of the side of the ink-receiving layer and the value (Y) of the side of the substrate were measured by a Macbeth reflection densitometer.

In the following, the results of the evaluation for the bleeding of ink are shown in Table 1, the reflection density of the ink jet recording sheet of Example 1 is shown in Table 2, the reflection density of the ink jet recording sheet of Example 2 is shown in Table 3, the reflection density of the ink jet recording sheet of Comparative Example 1 is shown in Table 4, the reflection density of the ink jet recording sheet of Comparative Example 2 is shown in Table 5 and the reflection density of the ink jet recording sheet of Example 3 is shown in Table 6.

TABLE 1

| | Example 1 | Example 2 | Comparative Example 1 | Comparative Example 2 | Example 3 |
|---|---|---|---|---|---|
| Bleeding of ink (note) | ○ | ○ | X | X | ○ |

(Note) ○ Ink bleeding was not observed, X Ink bleeding was observed.

TABLE 2

| Reflection density of Example 1 | Black | Cyan | Magenta | Yellow |
|---|---|---|---|---|
| Substrate side (Y) | 1.32 | 1.53 | 1.18 | 1.34 |
| Receiving layer side (X) | 1.27 | 1.10 | 1.00 | 1.01 |
| (Y)/(X) | 1.04 | 1.39 | 1.18 | 1.33 |

TABLE 3

| Reflection density of Example 2 | Black | Cyan | Magenta | Yellow |
|---|---|---|---|---|
| Substrate side (Y) | 1.25 | 1.50 | 1.12 | 1.29 |
| Receiving layer side (X) | 1.22 | 1.05 | 0.98 | 1.02 |
| (Y)/(X) | 1.02 | 1.43 | 1.14 | 1.26 |

TABLE 4

| Reflection density of Comparative Example 1 | Black | Cyan | Magenta | Yellow |
|---|---|---|---|---|
| Substrate side (Y) | 1.89 | 1.79 | 1.49 | 1.73 |
| Receiving layer side (X) | 1.51 | 1.43 | 1.32 | 1.41 |
| (Y)/(X) | 1.25 | 1.25 | 1.13 | 1.23 |

TABLE 5

| Reflection density of Comparative Example 2 | Black | Cyan | Magenta | Yellow |
|---|---|---|---|---|
| Substrate side (Y) | 1.60 | 1.56 | 1.49 | 1.51 |
| Receiving layer side (X) | 1.30 | 1.24 | 1.25 | 1.26 |
| (Y)/(X) | 1.23 | 1.26 | 1.19 | 1.20 |

TABLE 6

| Reflection density of Example 3 | Black | Cyan | Magenta | Yellow |
|---|---|---|---|---|
| Substrate side (Y) | 1.33 | 1.45 | 1.16 | 1.30 |
| Receiving layer side (X) | 1.29 | 1.22 | 0.98 | 1.14 |
| (Y)/(X) | 1.03 | 1.19 | 1.18 | 1.14 |

(Result of Evaluation)

With regard to the ink jet recording sheets of Examples 1, 2 and 3, the bleeding of ink was not observed. Also, the value of Y/X was 1.0 or more and an image having a high developed color density could be projected as viewed from the substrate side.

On the contrary, with regard to the ink jet recording sheets of Comparative Examples 1 and 2, the power of holding an ink solvent was deficient in the ink-receiving layer because the ink solvent is not absorbed in the intermediate layer and the bleeding of ink occurred. Although the recording sheets of Comparative Examples 1 and 2 respectively had a value (Y/X) of 1.0 or more, the bleeding of ink occurred as shown in FIG. 1 and therefore an unappreciable image was obtained.

What is claimed is:

1. An ink jet recording sheet comprising an intermediate layer and an ink-receiving layer laminated on a light-transmittable substrate, wherein the intermediate layer is formed of a rubber-based resin, the receiving layer is formed of a hydrophobic resin and a ratio Y/X of reflection density Y of the substrate side to reflection density X of the receiving layer side in a print section when printing using oily ink on the receiving layer is 1.0 or more, wherein the rubber-based resin is a styrene-butadiene resin or a polynorbomene resin.

* * * * *